US006052868A

United States Patent [19]

Chen

[11] Patent Number: 6,052,868

[45] Date of Patent: Apr. 25, 2000

[54] UMBRELLA HANDLE WITH A HANGING LOOP

[76] Inventor: Chao-Lin Chen, No. 81, Lane 2, Jung Hua Road, Sec. 1, Hsinchu, Taiwan

[21] Appl. No.: 09/401,959

[22] Filed: Sep. 22, 1999

[51] Int. Cl.[7] ..... A45B 25/00

[52] U.S. Cl. ..... 16/110.1; 135/15.1; 135/25.4; 135/72; 294/137; 294/171; 16/111.1

[58] Field of Search ..... 294/137, 171; 280/821, 822; 16/110.1, 111.1, 110 R, 110.5, 421, 428, 430, 442, DIG. 12, DIG. 25; 135/15.1, 25.4, 25.41, 72

[56] References Cited

U.S. PATENT DOCUMENTS 4,616,868 10/1986 Okuda ..... 135/25.4 X
4,624,276 11/1986 Allen ..... 16/111.1

*Primary Examiner*—Robert Canfield
*Attorney, Agent, or Firm*—Rosenberg, Klein & Lee

[57] ABSTRACT

This invention relates to an improved umbrella handle with a hanging loop, wherein the hanging loop is capable of being winded around the handle and being fixed securely. The umbrella handle is provided a spiral concave groove of the surface which can be winded by the loop for obtaining a merged connection. A fixing ring is provided around the loop and is slidable to control a secure connection between the loop and the handle or to be released.

1 Claim, 3 Drawing Sheets

UMBRELLA HANDLE WITH A HANGING LOOP

BACKGROUND OF THE INVENTION

For easily carrying an umbrella, a hanging loop is often provided on a handle of the umbrella. The hanging loop is useful when it is used but it becomes a burden at the time it is not used, since the loop might hook other objects and makes unnecessary trouble. The umbrella with the prior known loop is out of enough utility.

A main objective of the present invention is to provide an improved umbrella which includes an improved umbrella handle with a hanging loop, wherein the hanging loop is capable of being winded around the handle and being fixed securely.

Now the structure and features of the present invention will be described in detailed with reference to the accompanying drawings.

DETAILED DESCRIPTION OF THE PREFERRED EMBODIMENTS

Figure 1:
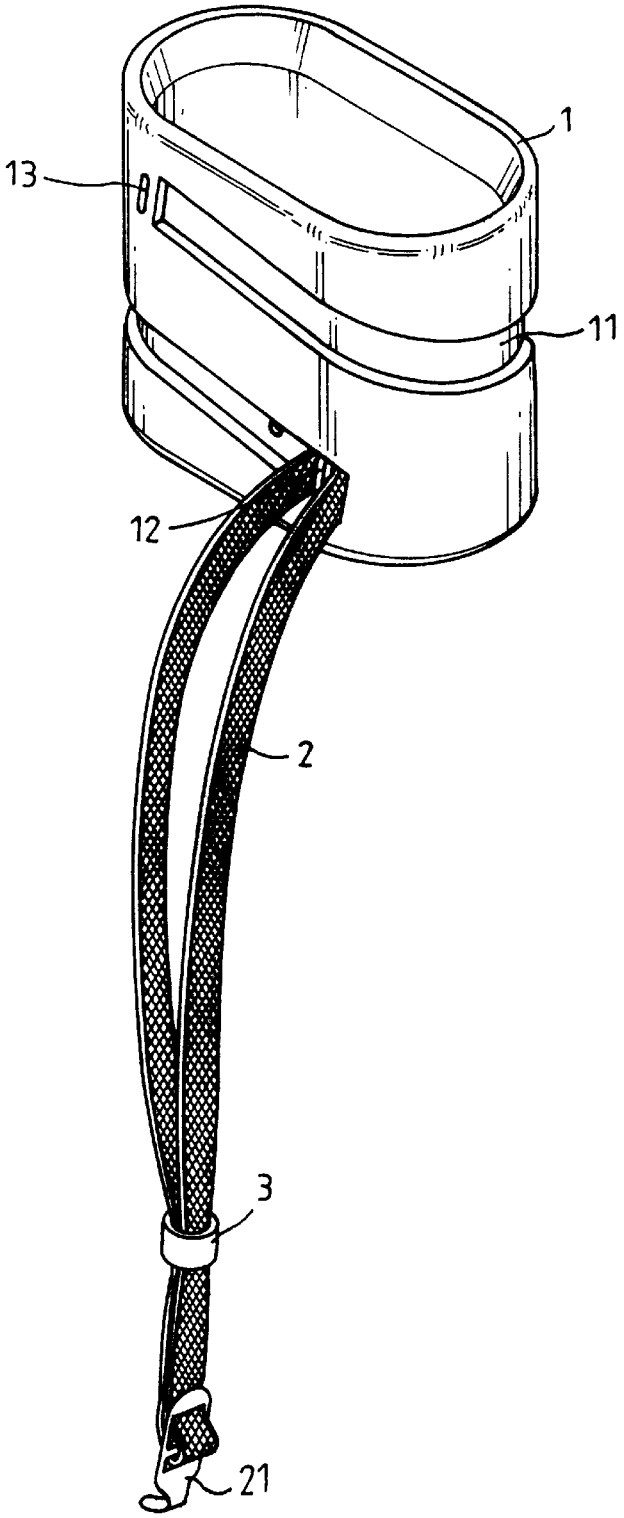
FIG. 1 is a perspective view of an umbrella handle with a hanging loop according to the present invention.

It can be seen that the improvement of the present invention is on the design of the umbrella handle (1), which is formed with a spiral concave groove (11) thereon. A beam (12) is provided at an end of the groove (12) and a connecting slot (13) is formed near the other end of the same. A hanging loop (2) is connected on the beam (12) and is provided with a connecting hook (21) at its free end. A fixing ring (3) is provided around the loop (2) slidably.

Figure 2:
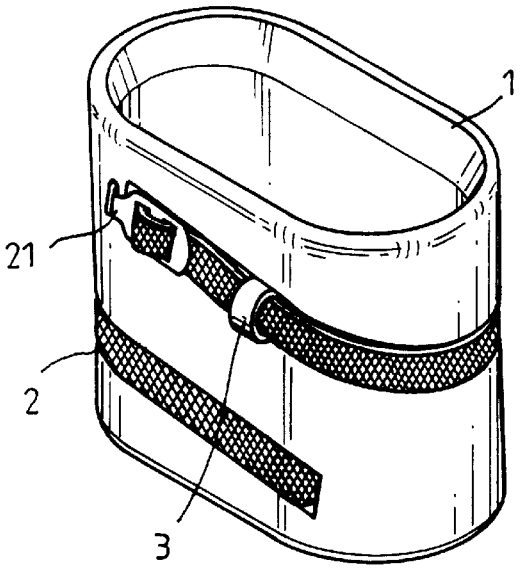
FIG. 2 is a perspective view of FIG. 1 in which the loop is winded around the handle.
Figure 3:
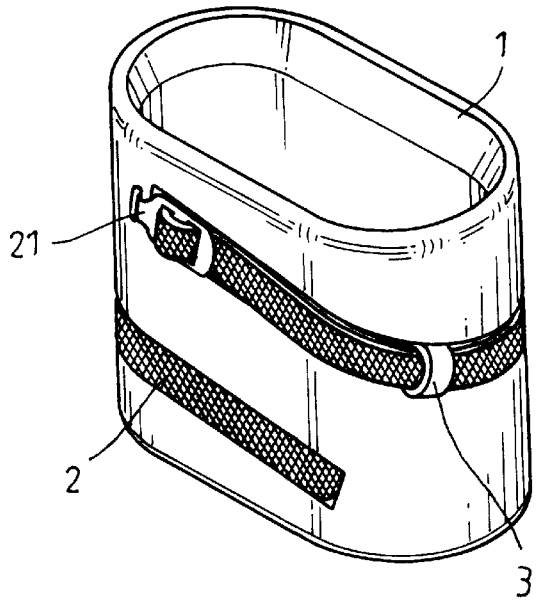
FIG. 3 is a perspective view of FIG. 2 in which a fixing ring around the loop is adjusted to be moved sideward for a secure connection.
Figure 4:
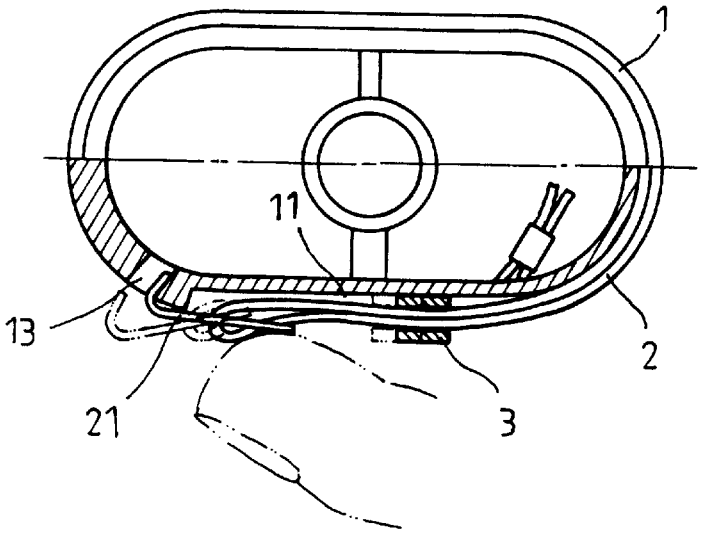
FIG. 4 is a cress-sectional view of FIG. 2.
Figure 5:
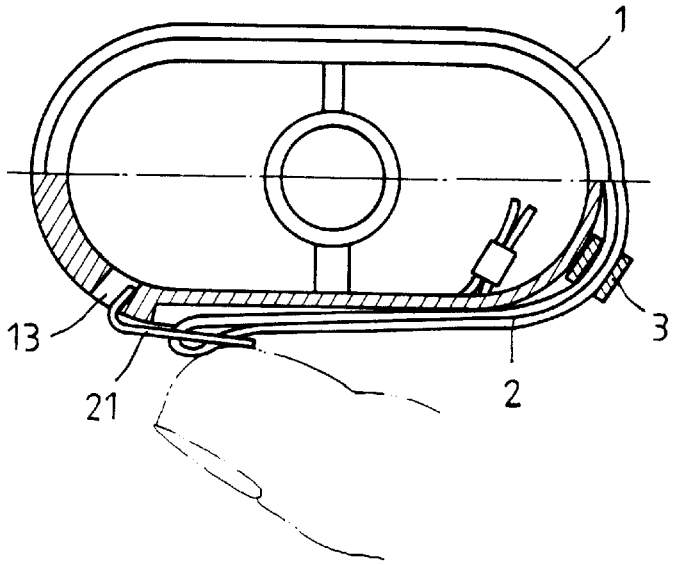
FIG. 5 is a cress-sectional view of FIG. 3.

Usually, the loop (2) is hung as shown in FIG. 1. When the loop (2) of this invention is not to be used, it can be winded, alone the groove (11), around the handle (1) and the hook (21) can be engaged within the slot (13) on the handle (1) as shown in FIGS. 2 and 4. It is to be understood that the loop (2) is therefore connected and merged with the handle (1), that prevent from the trouble of a known structure. At the time, if the fixing ring (3) is moved away from hook (21), as in FIGS. 3 and 5, the connection between the handle (1) and the loop (2) is thus more secured and firmed. In order to release the hook (21) from the slot (13) of the handle (1), the fixing ring 3 can be moved in a direction toward the hook (21), as FIGS. 2 and 4, and a space is formed between the loop (2) and the groove (11). The hook (21) can be released by pressing the bottom segment of itself from the slot (13).

I claim:

1. An umbrella handle with a hanging loop including a handle formed with a spiral concave groove thereon, a beam provided at an end of the groove and a connecting slot formed near the other end of the same, and a hanging loop connected on the beam and provided with a connecting hook at its free end; a fixing ring provided around the loop slidably; while the loop being able of being winded along the groove around the handle to obtain a merged connection, and to move the fixing ring to control the secure connection or to be released.

* * * * *